United States Patent [19]

Kolpe et al.

[11] Patent Number: 4,969,534

[45] Date of Patent: Nov. 13, 1990

[54] HEARING AID EMPLOYING A VISCOELASTIC MATERIAL TO ADHERE COMPONENTS TO THE CASING

[75] Inventors: Vasant V. Kolpe; Davis W. Chamberlin; Robert J. Oliveira, all of St. Paul, Minn.

[73] Assignee: Minnesota Mining and Manufacturing Company, St. Paul, Minn.

[21] Appl. No.: 229,614

[22] Filed: Aug. 8, 1988

[51] Int. Cl.[5] ..... H04R 25/02

[52] U.S. Cl. ..... 181/130; 181/135; 381/68.6; 381/69; 381/188; 381/205

[58] Field of Search ..... 181/129, 130, 131, 134, 181/135; 381/68–69.2, 158, 188, 189, 205

[56] References Cited

U.S. PATENT DOCUMENTS

| | | | |
|---|---|---|---|
| 3,448,224 | 6/1969 | Giller . | |
| 3,529,102 | 9/1970 | Rosenstand | 381/69.2 X |
| 3,605,953 | 9/1971 | Caldwell et al. | 188/1 |
| 4,034,639 | 7/1977 | Caldwell | 83/835 |
| 4,223,073 | 9/1980 | Caldwell et al. | 428/422 |
| 4,447,493 | 5/1984 | Driscoll et al. | 428/332 |
| 4,520,236 | 5/1985 | Gauthier | 381/69 X |
| 4,617,429 | 10/1986 | Bellaflore | 381/69 X |
| 4,620,605 | 11/1986 | Gore et al. | 181/135 |
| 4,654,554 | 3/1987 | Kishi | 381/158 |
| 4,729,451 | 3/1988 | Brander et al. | 181/130 |

OTHER PUBLICATIONS

3M Product Information Bulletin, 70-0702-02-35-6(18.05)CFD257A.

*Primary Examiner*—Benjamin R. Fuller

*Attorney, Agent, or Firm*—Donald M. Sell; Walter N. Kirn; James V. Lilly

[57] ABSTRACT

The casing of a hearing aid can be acoustically dampened and its receiver is less likely to amplify noise stemming from vibrations of the casing when the casing is lined with a viscoelastic material. The viscoelastic lining can be applied by laying a viscoelastic layer across the rim of the casing and drawing a vacuum at the sound-communicating orifice of the casing until the viscoelastic is drawn tightly against the interior of the casing. A preferred viscoelastic layer has at one surface a substance such as fibers or beads that will form temporary bridges to permit an air to be evacuated between the viscoelastic layer and a casing to which it is applied. When the deposited viscoelastic is tacky at room temperature, the components of the hearing aid can be positioned simply by pressing them into the viscoelastic material, thus making the assembly easier than prior methods of assembling tiny hearing aids.

11 Claims, 2 Drawing Sheets

HEARING AID EMPLOYING A VISCOELASTIC MATERIAL TO ADHERE COMPONENTS TO THE CASING

BACKGROUND OF THE INVENTION

1. Field of the Invention

The invention concerns hearing aids and their assembly and is especially concerned with the long-felt need to avoid the amplification of noise caused by vibrations of either the casing or the components of the hearing aid.

2. Description of the Related Art

Hearing aids, particularly in-the-ear and in-the-canal aids, have become exceeedingly small. The casing of such a hearing aid usually contains both a microphone and a loud speaker (usually called a "receiver") which, because of their tiny size, are both delicate and difficult to handle. Their close proximity in the casing makes it difficult to avoid acoustic feedback. The microphone can additionally pick up and amplify noise from vibrations in the casing such as can be caused by external sources such as the wearer's footsteps.

The delicate nature of the receiver and microphone makes them subject to damage from shock such as when the hearing aid is accidentally dropped, as often happens because of the tiny size of the hearing aid and because its external surface often is slippery. The tiny size and tapered shape of an in-the-canal hearing aid makes it susceptible to come loose and fall from the wearer's ear.

In order to make them easier to handle and less susceptible to damage, each of the receiver and microphone are often fitted into a tiny rubber boot. For example, see U.S. Pat. No. 3,448,224 (Giller). See also the discussion of prior art in U.S. Pat. No. 4,620,605 (Gore et al.) where the boot is called a "buffer" or a "rubber bucket." The boot that the Gore patent calls "prior art" has radially extending rubber spikes which serve to locate each of the boots within a rigid plastic frame. Boots take up valuable space, and when they have spikes, they take up even more space, thus interfering with the trend toward miniaturization that is so important in current hearing aid design.

In the invention of the Gore patent, the ends of each boot are formed to permit it to be suspended in air between two fixed points and thus isolated as much as possible from structure-borne vibrations. Air suspension tends to require even more space than a rubber boot.

After the receiver and microphone have been inserted into the casing of a hearing aid, a potting compound is sometimes poured into the casing, but this makes it impractical to recover any of the parts. U.S. Pat. No. 4,520,236 (Gauthier), which concerns packing an acoustic foam material around the receiver, says that this "substantially prevents mechanical vibrations of the receiver from being transmitted to the earmold, thereby preventing feedback from this source" (col. 3, lines 22–30).

In U.S. Pat. No. 4,617,429 (Bellaflore), each of the receiver and microphone is housed in a nondescript, sleeve-like member into which a quick setting silicone material is poured. "The silicone material as used to fix the components in place also acts as a insulating medium to insure greater fidelity of sound received in the auditory canal of the user" (col. 5, lines 44–47).

In U.S. Pat. No. 4,729,451 (Brander et al.), a shaped mandrel is placed inside the casing of a hearing aid and the space between the mandrel and the casing is filled with a polymerizable liquid such as a room temperature vulcanizing silicone. After removing the mandrel, a receiver is inserted into the cavity created by the mandrel and thus is cradled by the polymerized silicone. This is said to lower the level of mechanical and acoustic feedback transmitted by the receiver.

In addition to the above-discussed techniques that have been used in attempts to reduce noise amplification, some hearing aids include electronic devices to filter out noise. Not only are electronic devices quite expensive, but they also can take up valuable space.

OTHER PRIOR ART

Layers of viscoelastic material have been used to damp vibrations, usually in combination with a constraining layer such as a soft aluminum foil. For example, see U.S. Pat. No. 4,447,493 (Driscoll et al.); U.S. Pat. No. 4,223,073 (Caldwell et al.); and U.S. Pat. No. 4,034,639 (Caldwell). Viscoelastic material that can be used for such purposes is made by 3M as Scotchdamp TM "SJ2015X Viscoelastic Polymer Types 110, 112 and 113." Types 112 and 113 are pressure-sensitive adhesives at room temperature and require only nominal pressure to effect a good bond. Type 110 must be heated to become a pressure-sensitive adhesive and can effect a good bond at moderately elevated temperatures. For a discussion of loss factor $\eta$, dynamic shear storage modulus G', and the dynamic shear loss modulus G'' (the product of the loss factor and G') of this viscoelastic material, see 3M Product Information Bulletin 70-0702-0235-6(18.05)CFD257A.

SUMMARY OF THE INVENTION

The invention significantly reduces noise amplified by the receiver of a hearing aid by better isolating the receiver from the casing and also by better isolating the microphone from vibrations of the casing. The invention also helps to protect components of the hearing aid against damage when dropped. Briefly, the invention concerns a hearing aid having a casing containing a transducer and a viscoelastic layer adhering the transducer to the casing, which layer has, at a frequency of 1000 Hz and a temperature of 100° F. (38° C.), a loss factor of at least 0.5 and a shear storage modulus G' of at least $10^7$ dynes/cm$^2$. Preferably the dynamic shear loss modulus G'' (i.e. the product of the loss factor and the dynamic shear storage modulus G') is at least $1.5\times10^7$ dynes/cm$^2$ in order to provide good isolation of the microphone. Even better isolation is achieved when the dynamic shear loss modulus G'' is at least $2.5\times10^7$ dynes/cm$^2$ at 1000 Hz and 38° C.

The term "transducer" encompasses a receiver or a microphone or a module containing both a receiver and a microphone.

The viscoelastic layer preferably has a thickness of from 0.2 to 0.8 mm. It preferably is tacky when the transducer is placed into the casing and this adheres the transducer to the casing. To do so the viscoelastic layer may be tacky at room temperature or may become tacky at a moderately elevated temperature such as 60° C. However, when the viscoelastic layer does not adhere well either to the transducer or to the casing, an adhesive can be used to do so.

When the viscoelastic is tacky at room temperature, the novel hearing aid can be assembled simply by pressing the viscoelastic layer against the interior surface of the casing and then pressing a transducer assembly into the tacky viscoelastic layer. When the tackiness of the viscoelastic layer interferes with the ability to position the transducer, the layer may be temporarily detackified by known techniques, e.g., by cooling or by applying a volatile liquid or by applying rupturable glass microballoons.

The viscoelastic layer can either be die-cut to fit into the casing, or it can be laid across the rim of the casing and drawn against the interior of the casing by a vacuum applied at the sound-communicating orifice or another opening through the casing.

When so using a vacuum, it is desirable to avoid trapping air between the viscoelastic layer and the underlying surface of the casing. This can be done by scratching the casing to form one or more channels extending across the interior surface from the sound-communicating orifice or other opening at which the vacuum is to be applied. The trapping of air can instead be avoided by applying to the underside of the viscoelastic layer a substance that will form at least one temporary bridge between the interior surface of the casing and the viscoelastic layer before the latter is drawn tightly against the former. This can be done by placing a single fiber on the surface of the viscoelastic layer, which fiber extends across the interior surface of the casing from the opening at which the vacuum is being applied. Preferably a plurality of fibers are applied to the viscoelastic layer to ensure that at least one fiber emanates from the opening at which the vacuum is being applied. The fibers can be blown microfibers that have been deposited onto the viscoelastic layer. Useful blown microfibers include polypropylene, polybutene, and polyurethane and can be as thin as one micrometer. Also useful are natural keratin fibers.

Instead of depositing fibers, a preformed open nonwoven web can be adhered to the viscoelastic layer to create temporary bridges to evacuate air from between the viscoelastic layer and the underlying interior surface of the casing. A nonwoven web should be sufficiently extensible not to interfere with the stretching of the viscoelastic layer. Whether or not the fibers are in the form of a nonwoven web, they preferably cover no more than about 30% of the underside area of the viscoelastic layer.

In another technique, the underside of the viscoelastic layer is partially covered with microparticles such as glass beads. Microparticles may be applied to the viscoelastic layer by spraying, electrostatically depositing, or silk-screening to be more densely applied at the portions of the viscoelastic layer that will contact the sound-communicating orifice or other opening at which the vacuum is to be applied, especially when the viscoelastic layer will be stretched to a greater extent in the vicinity of that opening. This better assures continued bridging by the microparticles until the viscoelastic layer has become seated against the interior surface of the casing.

The maximum diameter of the microparticles or fibers preferably is so small that the outer surface of the viscoelastic layer is substantially smooth after it has been pulled by the vacuum tightly against the interior surface of the casing. This enhances the adhesion between the viscoelastic layer and the transducer or transducers. To permit the outer surface of the viscoelastic layer to be smooth, the maximum diameter of the microparticles or fibers should be less than 50% of the thickness of the deposited viscoelastic layer. Because the viscoelastic layer may be stretched when applied by vacuum, the maximum diameter of the microparticles or fibers preferably is less than 25% of the original thickness of the viscoelastic layer.

Temporary bridges can also be provided by embossing the underside of the viscoelastic layer, e.g., by forming it on an embossed low-adhesion release liner. When the embossed viscoelastic layer is tacky at room temperature, it should be chilled while being drawn by vacuum against the interior surface of the casing until its textured underside has served the purpose of avoiding entrapped air.

When shipping or storing a viscoelastic layer which is covered by a substance that forms temporary bridges, care should be taken not to apply a force against that substance which might cause it to become prematurely embedded into the viscoelastic material. Hence, shipping/storage cartons should be provided with partitions that maintain a space between adjacent viscoelastic layers. However, it is preferred to keep both surfaces of the viscoelastic layer protected with lightweight disposable release liners to keep them from accumulating dust or other environmental debris.

In the manufacture of hearing aids, it is usual to secure a faceplate to the casing by using a solvent. To afford a good bond, the viscoelastic layer preferably does not cover the rim of the casing at which the faceplate is to be attached. This is most easily accomplished by mechanically removing viscoelastic material at the rim, usually after cooling the viscoelastic material to a temperature at which it is non-tacky. Sufficient viscoelastic material should remain to acoustically damp the casing and to assure that the viscoelastic material separates the transducer from the casing, thus effectively limiting the transmission of vibrations between the transducer and the casing.

It may be desirable to adhere the microphone to the faceplate, in which event the faceplate should be covered with a viscoelastic layer that can serve to hold the microphone in place. Even when the microphone (or a module containing both the microphone and the receiver) is to be adhered to the viscoelastic layer on the interior surface of the casing, the inner facing surface of the faceplate may be covered with viscoelastic material, especially if there is any chance that a transducer might contact the faceplate in the assembled hearing aid.

Another method for assembling a hearing aid of the invention involves applying a layer of viscoelastic material to a transducer and using that layer of viscoelastic material to adhere the transducer to the casing. When the transducer is a module including both the receiver and microphone, viscoelastic material should also be employed to isolate the microphone from the receiver before the module is assembled.

The casing can either form the exterior of the hearing aid or can be inserted into a housing that forms the exterior. In the latter event, the casing preferably is adhered to the interior wall of the housing by another layer of viscoelastic material that also has a dynamic shear loss modulus G'' of at least $1.5\times10^7$ dynes/cm$^2$ at a frequency of 1000 Hz and a temperature of 38° C. By doing so, components of the novel hearing aid would be even more isolated from shock and noise-generating vibrations.

Preferred viscoelastic materials that are tacky pressure-sensitive adhesives at room temperature or at moderately elevated temperatures are disclosed in U.S. Pat. No. 3,605,953 (Caldwell et al.) and in U.S. Pat. No.

4,447,493 (Driscoll et al.), which disclosures are incorporated by reference. As in the Driscoll patent:

"Procedures for determining the loss tangent and storage modulus of materials are well known in polymer physics and are described, for example, by Miles, *J. Appl. Phys.* 33 (4), 1422–1428 (1962). Measurements reported herein were made using a Dynamic Shear Rheometer, Model CSR-1, from Melabs of Palo Alto, Calif., that had been modified to ensure parallel alignment of the driver and pickup piezoelectric transducers. Stress on the sample and phase shift were read directly using state of the art amplifiers and a phase network analyzer to monitor the output electrical signal" (col. 9, lines 13–24).

THE DRAWING

The invention may be more easily understood in reference to the drawing, all figures of which are schematic. In the drawing.

Figure 2:
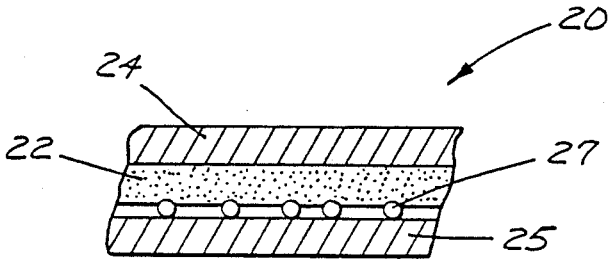
FIG. 2 is a central cross section through sheeting that is useful for applying a viscoelastic layer to the interior surface of the casing of a hearing aid.
Figure 4:
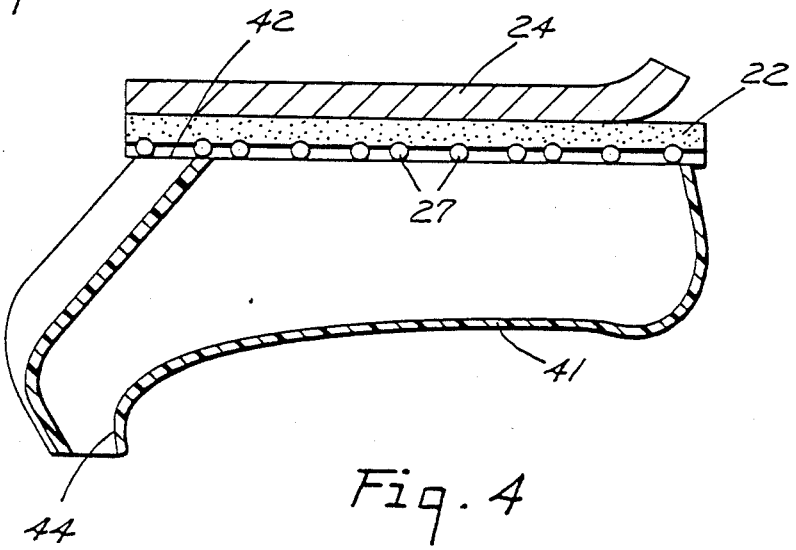
Figure 5:
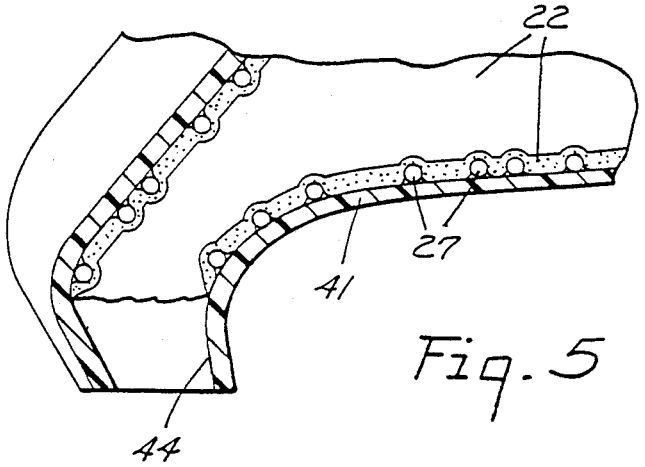

FIG. 4 is a central cross section through the casing of an in-the-ear hearing aid of the invention to show a first step of applying a viscoelastic layer to the interior surface of the casing, using the sheeting shown in FIG. 2; and FIG. 5 is an enlarged fragment of the cross section of FIG. 4 at the sound-communicating orifice after the viscoelastic layer has been drawn by vacuum against the interior surface of the casing.

DETAILED DESCRIPTION OF THE INVENTION

Figure 1:
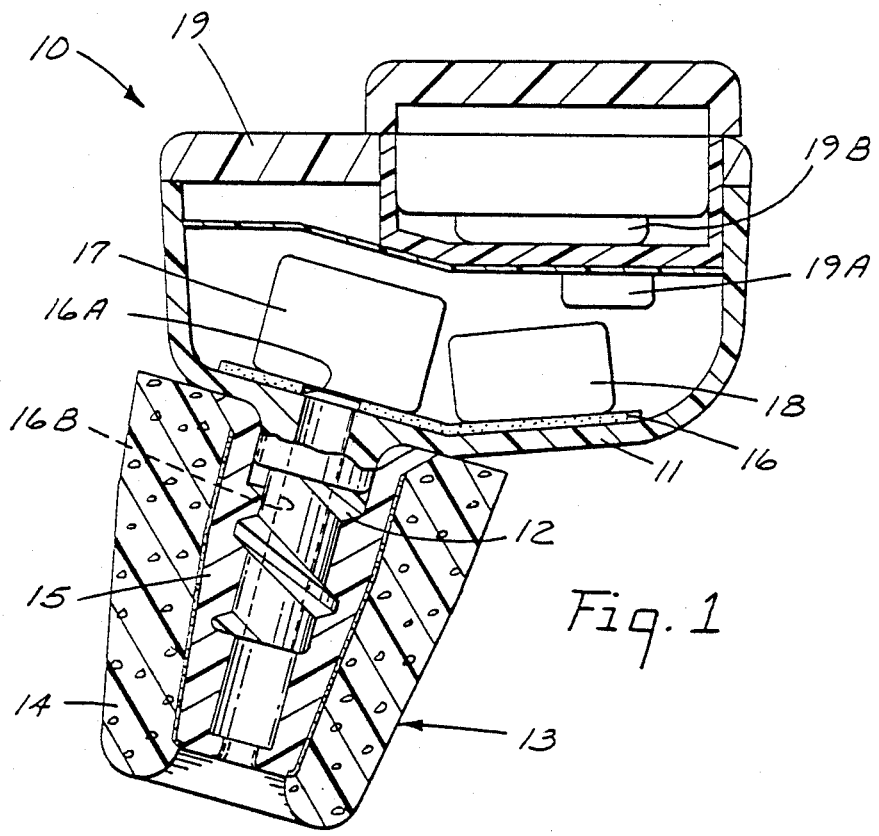
FIG. 1 is a central cross section through an in-the-canal hearing aid of the invention.

In FIG. 1, an in-the-canal hearing aid 10 has a casing 11, the external surface of which is formed with a male screw thread 12. Mating with the thread 12 is a sleeve 13 consisting of retarded recovery foam 14 surrounding an internally threaded plastic duct 15. By compressing the sleeve, it can be inserted into the canal of the wearer's ear and then expands to hold the hearing aid tightly, but comfortably, in place.

A tacky viscoelastic layer 16 has been die-cut to fit against the interior surface of the casing 11 with an opening 16A over a sound-communicating orifice 16B in the casing. A receiver 17 and a microphone 18 have been pressed into the viscoelastic layer to hold them in place as shown. The casing has been closed by a faceplate 19 to which an amplifier 19A and a battery 19B have been attached.

FIG. 2 shows in central cross section a sheeting 20 including a viscoelastic layer 22 between two low-adhesion release liners 24 and 25. At one surface of the viscoelastic layer are fibers or beads 27.

Figure 3:
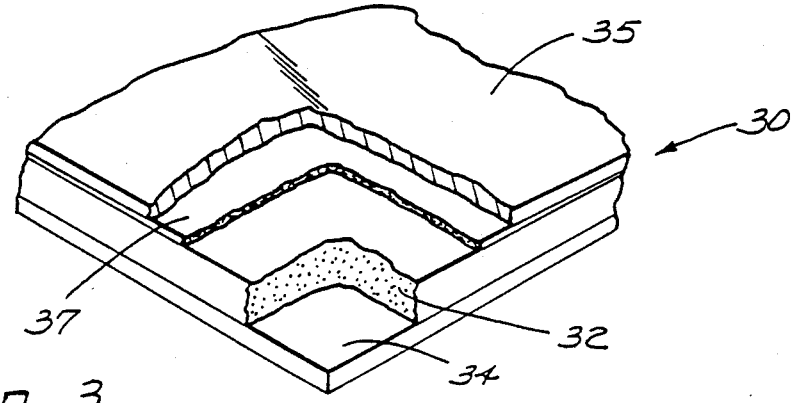
FIG. 3 is an isometric view, broken away in part, of a fragment of another sheeting that is useful for applying a viscoelastic layer to the interior surface of the casing of a hearing aid.

FIG. 3 shows a sheeting 30 including a viscoelastic layer 32 between two low-adhesion release liners 34 and 35. At one surface of the viscoelastic layer is an open mesh 37 of fine flexible fibers. The mesh 37 can be provided by a nonwoven fabric or by randomly depositing fibers, e.g., blown microfibers, onto the viscoelastic layer 32.

In FIG. 4, a casing 41 of an in-the-ear hearing aid has been custom molded to fit into the wearer's ear. The casing is open at a rim 42. Laid across the rim is a piece of the sheeting 20 of FIG. 2, one low-adhesion release liner 25 of which has been removed. The other low-adhesion release liner 24 is shown being peeled away, after which a vacuum is to be applied at a sound-communicating orifice 44. In FIG. 5, the vacuum has drawn the viscoelastic layer 22 tightly against the interior surface of the casing 41 until the viscoelastic layer has been broken by the vacuum at the sound-communicating orifice 44. Thus, the fibers or beads 27 have become completely embedded into the viscoelastic material, having completed their function of acting as bridges to permit air to be drawn from between the viscoelastic layer and the interior surface of the casing 41 and exhausted through the sound-communicating orifice 44.

EXAMPLE 1

Used in this example was a plastic casing as illustrated in FIG. 1 of the drawing. The casing was about 14 mm wide in the plane of FIG. 1, about 10 mm wide perpendicular to that plane, and about 6 mm deep. Its rim was 0.75 mm in width.

A flexible viscoelastic layer was made by photopolymerizing a mixture of by weight 90 parts isooctyl acrylate and 10 parts acrylic acid that had been partially polymerized to a coatable viscosity and then knife-coated onto silicone-coated paper that served as a disposable release liner. The viscoelastic layer, which was 0.4 mm in thickness, was then covered with an identical disposable release liner.

The loss factor of the viscoelastic layer was 1.1 and its shear storage modulus G′ was $2.5\times10^7$ dynes/cm$^2$ measured at 1000 Hz and 38° C.

One end of a fine-celled, urethane-foam applicator (8 mm diameter and 20 mm long) was dipped into a dish of glass beads (microspheres 80–105 μm in diameter having a density of 4 g/cm$^3$). The applicator was then lightly tapped until the beads remaining on the applicator were almost invisible. After removing one of the release lines, the applicator was dabbed on the exposed surface of the viscoelastic layer to which most of the beads transferred to provide a sparse monolayer. The viscoelastic layer and its remaining release liner were then cut to overhang the rim of the casing about 1 mm. After pressing the viscoelastic layer against the rim, the release liner was peeled off. A vacuum (60 cm Hg) was applied at the sound-communicating orifice, pulling and stretching the viscoelastic layer against the interior surface of the casing and breaking it to leave an opening at the sound-communicating orifice. Visual examination revealed that the glass beads had prevented air from becoming entrapped and that the viscoelastic layer tightly conformed to the interior of the casing.

The deposited viscoelastic layer was tacky but became tack-free when chilled, thus permitting the viscoelastic material to be removed from the rim of the casing with a sharp instrument, thus leaving a clean surface. After allowing the viscoelastic layer to return to room temperature, it again became tacky, and tweezers were used to press a microphone and a receiver into the viscoelastic material in positions as in FIG. 1. Each of these transducers stayed in place after the assembly had been dropped onto a hard floor several times.

EXAMPLE 2

Using the point of a knife, two grooves were formed in the interior bottom surface of a plastic casing as illustrated in FIG. 1. Each groove was 40–80 μm, both in depth and width, and extended from the sound-communicating orifice to one of the far corners of the casing. A piece of an exposed viscoelastic layer as described in Example 1 (but having no glass beads) was pressed onto the rim of the casing to overhang about 1 mm. After removing the release liner, a vacuum (60 cm Hg) was applied at the sound-communicating orifice, thus drawing the viscoelastic layer tightly against the interior surface of the casing without entrapping air. The viscoelastic layer broke at the sound-communicating orifice to leave it open.

The deposited viscoelastic layer was employed to position a receiver in a casing as illustrated in FIG. 1. The casing was dropped several times onto a wood table from a height of more than one meter without any visible damage.

EXAMPLE 3

A single layer of viscoelastic material as described in Example 1, 0.4 mm in thickness, was wrapped around a receiver, leaving uncovered the wall containing the sound port. This then was installed in an in-the-ear hearing aid with the viscoelastic layer adhering the receiver to the casing. Then the hearing aid was tested for output signal distortion using a Frye 6500 harmonic distortion analyzer according to ANSI Hearing Instrument Testing Standard 1986. Also tested for comparison was an identical hearing aid except employing a rubber boot instead of the viscoelastic layer. The hearing aid employing viscoelastic material showed 20–30% less total harmonic distortion at S/N 104 and 80 dB sound pressure level.

The term "hearing aid" as used in this application encompasses any hearing device that employs a miniature transducer of a size suitable for use in an ordinary hearing aid, e.g., a headset, a listening bug, or a paging receiver.

What is claimed is:

1. A hearing aid comprising a casing containing an interior surface and a transducer, and a viscoelastic layer provided on said interior surface for adhering the transducer to the casing, which layer has, at a frequency of 1000 Hz and a temperature of 38° C., a dynamic shear loss modulus G″ of at least $1.5\times10^7$ dynes/cm$^2$.

2. A hearing aid as defined in claim 1 wherein the viscoelastic layer substantially covers the interior surface of the casing.

3. Hearing aid as defined in claim 1 and further comprising a faceplate having an inner surface.

4. Hearing aid as defined in claim 3 wherein the inner surface of the faceplate is substantially covered by an additional viscoelastic layer which has, at a frequency of 1000 Hz and a temperature of 38° C., a dynamic shear loss modulus G″ of at least $1.5\times10^7$ dynes/cm$^2$.

5. Hearing aid as defined in claim 1 wherein the viscoelastic layer substantially covers the transducer.

6. Hearing aid as defined in claim 1 wherein said viscoelastic layer is a pressure-sensitive adhesive.

7. Hearing aid as defined in claim 6 wherein said pressure-sensitive adhesive is tacky at room temperature.

8. Hearing aid as defined in claim 6 wherein said pressure-sensitive adhesive is substantially tack-free at room temperature and becomes tacky when heated to 60° C.

9. Hearing aid as defined in claim 1 and also having an exterior housing, wherein the casing is adhered to an interior surface of the housing by an additional viscoelastic layer which has, at a frequency of 1000 Hz and a temperature of 38° C., a dynamic shear loss modulus G″ of at least $1.5\times10^7$ dynes/cm$^2$.

10. Hearing aid as defined in claim 1 wherein the shear loss modulus G″ is at least $2.5\times10^7$ dynes/cm$^2$.

11. A hearing aid comprising a casing, a viscoelastic layer provided on a portion of said casing which has a dynamic shear loss modulus G″ of at least $1.5\times10^7$ dynes/cm$^2$ at a frequency of 1000 Hz and a temperature of 38° C., and a transducer attached to said portion of the casing by means of the viscoelastic layer, whereby the viscoelastic layer isolates vibrations in the casing from the transducer.

* * * * *

UNITED STATES PATENT AND TRADEMARK OFFICE

CERTIFICATE OF CORRECTION

PATENT NO. : 4,969,534

DATED : November 13, 1990

INVENTOR(S) : Vasant V. Kolpe, David W. Chamberlin and Robert J. Oliveira

It is certified that error appears in the above-identified patent and that said Letters Patent is hereby corrected as shown below:

Column 5, line 52, after "16A" insert --centered--.

Signed and Sealed this

Twenty-sixth Day of May, 1992

*Attest:*

DOUGLAS B. COMER

*Attesting Officer*

*Acting Commissioner of Patents and Trademarks*